US006142232A

United States Patent [19]

Troutt et al.

[11] Patent Number: 6,142,232

[45] Date of Patent: Nov. 7, 2000

[54] METHOD AND APPARATUS FOR CLEANING WELLS

[75] Inventors: James Troutt, Burlington, Ky.; Neil Mansuy, Kansas City, Mo.

[73] Assignee: Layne Christensen Company, Mission Woods, Kans.

[21] Appl. No.: 09/115,917

[22] Filed: Jul. 15, 1998

[51] Int. Cl.[7] ..... E21B 37/00

[52] U.S. Cl. ..... 166/312; 166/305.1

[58] Field of Search ..... 166/311, 305.1, 166/263, 312, 306, 372

[56] References Cited

U.S. PATENT DOCUMENTS

| | | | |
|---|---|---|---|
| 3,743,021 | 7/1973 | McCauley et al. | 166/311 |
| 3,853,176 | 12/1974 | Henrich | 166/223 |
| 3,863,717 | 2/1975 | Cooper | 166/279 |
| 3,945,436 | 3/1976 | Nebolsine | 166/303 |
| 4,450,907 | 5/1984 | Clark et al. | 166/223 |
| 4,765,410 | 8/1988 | Rogers et al. | 166/303 |
| 4,793,417 | 12/1988 | Rumbaugh | 166/312 |
| 4,815,538 | 3/1989 | Burroughs | 166/312 |
| 5,146,988 | 9/1992 | Paul | 166/312 |
| 5,209,301 | 5/1993 | Ayres | 166/305.1 |
| 5,271,461 | 12/1993 | Decker et al. | 166/185 |
| 5,297,631 | 3/1994 | Gipson | 166/299 |
| 5,372,200 | 12/1994 | Merrill, Jr. | 166/369 |
| 5,394,942 | 3/1995 | Catania et al. | 166/302 |
| 5,515,923 | 5/1996 | Loree | 166/308 |

*Primary Examiner*—David Bagnell
*Assistant Examiner*—Jennifer R. Dougherty
*Attorney, Agent, or Firm*—Shook, Hardy & Bacon LLP

[57] ABSTRACT

A method and apparatus for cleaning the producing areas of water wells including screens and the surrounding formations. Chemicals that may be used for cleaning the well are applied through a surge tube and forced from the tube by gas such as carbon dioxide. At the same time, gas is injected into the well through an injection line which terminates below the surge tube. The opposing forces from the chemical application and gas injection drive the chemicals through the screen, gravel pack, and into the formation to dislodge and dissolve materials that tend to plug the well. When the chemical application and gas injection are stopped, the pressure in the well is reduced to draw the dislodged materials into the well. They are removed by a submersible pump or gas lift.

10 Claims, 2 Drawing Sheets

METHOD AND APPARATUS FOR CLEANING WELLS

FIELD OF THE INVENTION

This invention relates generally to the cleaning of wells and particularly to the cleaning of plugged water wells using a surging and development technique for dislodging materials from well screens and surrounding gravel packs and other formations.

BACKGROUND OF THE INVENTION

The screens which line water wells in one or more producing areas are subject to plugging by organic and inorganic materials, including micro-organisms and minerals such as iron, manganese, calcium and magnesium. The wells can also become plugged with fine particulate material from the surrounding formation. The gravel pack or other formation around the well is susceptible to becoming plugged by the same types of materials. The fractures of open hole rock wells also become plugged with the same types of materials. When the well becomes plugged, the flow of water into it is restricted, and the quality of the water can also suffer.

Various techniques have been proposed for cleaning the screens and surrounding gravel pack. For example, chemicals have been injected in order to chemically dissolve minerals and other materials. Mechanical agitators have been used to physically dislodge foreign materials from the screen. However, these approaches and other techniques that have been used have not been entirely effective in dealing with all of the problems of plugged wells.

SUMMARY OF THE INVENTION

The present invention is directed to a method and apparatus for cleaning wells through the use of a surging technique that may be coupled with chemical application in order to dislodge and/or dissolve materials that plug well screens and the surrounding formation. In accordance with the invention, a special well tool is provided for use in carrying out the well cleaning process. The well tool includes an inflatable packer that is connected with a tubing string, a surge tube, a gas injection line and a pump or gas lift system. The packer can be lowered into the well and inflated at a location above a screened area or open hole area that is to be cleaned. Gas applied to the surge tube may be used to force a chemical solution into the well or the gas may be used by itself. Simultaneously, gas is introduced through the injection line and enters the well at a depth below the surge tube or the location where the chemicals are applied. This results in a surging effect resulting from the forces of the chemical application and/or the gas injection. The surging action drives the chemicals or the gas out through the screen and into the formation to dislodge and/or dissolve the materials that plug the well.

When the chemical application and/or gas injection are terminated, the pressure in the well is reduced so that the dislodged materials are drawn into the well bore. Normally, the process is repeated in cyclical fashion to enhance the cleaning effect. The packer can be deflated so that the tool can be lowered or raised to the next screen level where the next zone can be treated in the same fashion. The pump or a gas lift process can be used to remove the dislodged materials individually from each zone. Alternatively, all of the dislodged materials can be removed at one time from the entire producing zone of the well by the described surging action and the gas lift removal.

BRIEF DESCRIPTION OF THE INVENTION

In the accompanying drawings which form a part of the specification and are to be read in conjunction therewith and in which like reference numerals are used to indicate like parts in the various views:

FIG. 1 is a diagrammatic elevational view of a well tool which is installed in a water well in accordance with one embodiment of the present invention; and FIG. 2 is a diagrammatic elevational view showing a modified tool installed in a well in accordance with another embodiment of the invention.

DETAILED DESCRIPTION OF THE INVENTION

Figure 1:
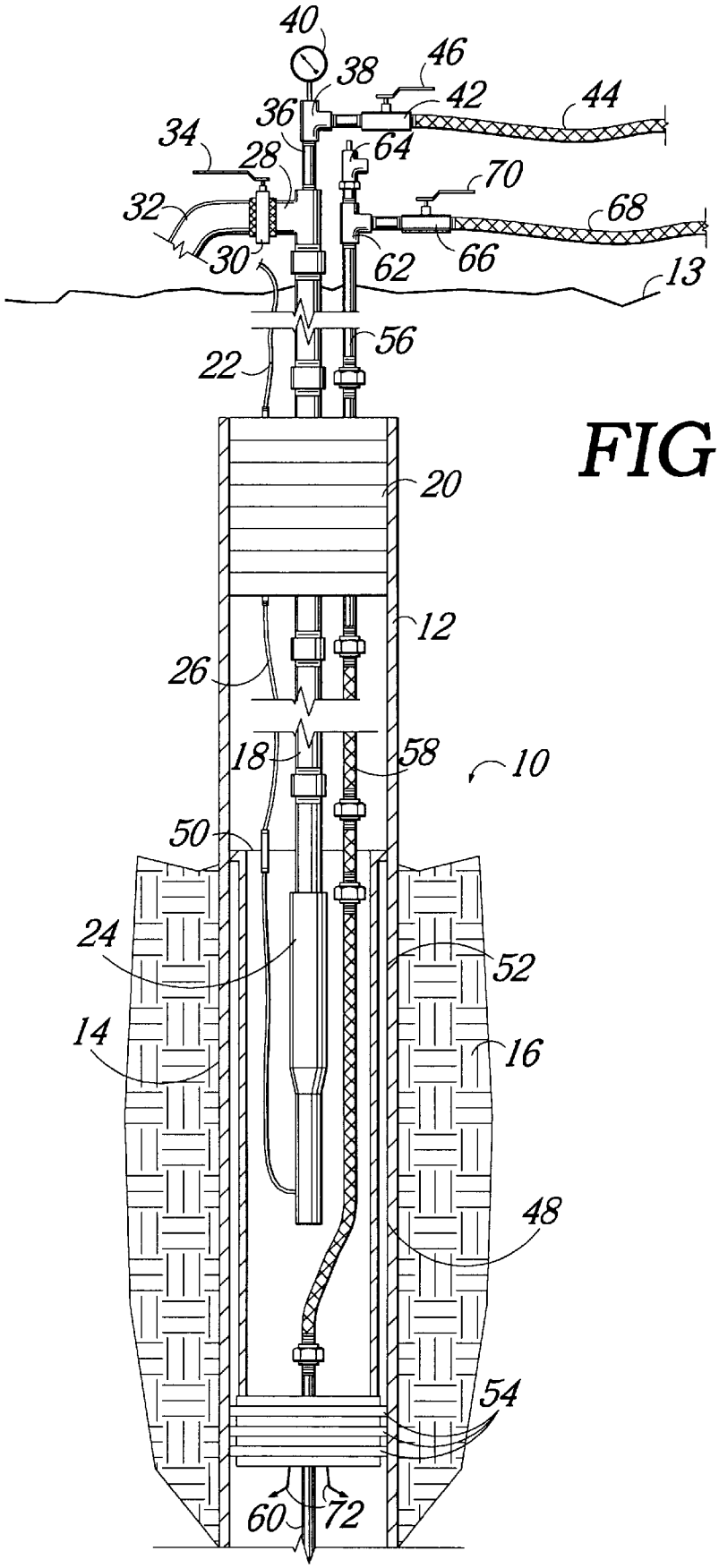

Referring now to the drawings in more detail and initially to FIG. 1, numeral 10 generally designates a water well having a vertical well bore 12 drilled into the ground from the surface 13. The bore 12 is lined at one or more producing zones with a screen 14 which allows water to flow into the well bore 12 from the surrounding formation which may be a gravel pack or natural formation such as that identified by numeral 16. The method and apparatus of the present invention is also applicable to open hole formations.

In accordance with the present invention, a tubing string 18 made up of pipe sections connected end to end or coiled tubing is connected with an inflatable packer 20. The packer 20 has an inflated condition (shown in FIG. 1) in which it expands to a size bearing against the wall of the well bore 12, thus securing the tool of the present invention in place in the well. The packer 20 can be deflated such that its size is reduced and it releases from the wall of the well bore 12, thus allowing the packer and related components to be moved upwardly and downwardly within the well 10. Air can be applied to and relieved from the packer 20 through an air line 22 which extends from above the surface 13 to connection with the packer 20.

The tubing 18 is used to direct water from the well 10 to the surface. A submersible pump 24 may be carried on the lower end of the tubing 18 and operated to pump water from within the well bore upwardly within the tubing 18. An electrical power line 26 for supplying electrical power to operate the pump 24 extends downwardly from the surface through the packer 20 to the electric motor which forms part of the pump 24.

A fitting 28 is secured to the top end of the tubing 18 at a location above the level of the ground 13. A side outlet from the fitting 28 connects through a valve 30 with a production line which receives water that is pumped from the well and directs it to the desired location. The valve 30 has a handle 34 which can be manually or automatically operated to open and close the valve and thus open and close line 32 to water flow from the well.

A surge line 36 extends downwardly through the top of the fitting 28 and into the interior of the tubing string 18. The top end of the surge line 36 is provided with a tee fitting 38 having a pressure gauge 40 on its top end. The side inlet to fitting 38 connects through a valve 42 with a supply hose 44. The end of the supply hose 44 can be connected with a supply of fluid used to clean the well. The fluid can include cleaning chemicals which may be in solution form. Alternatively or additionally, the end of the supply hose 44 connects with a supply of a gas such as nitrogen, air or carbon dioxide forming part or all of the fluid applied to the surge line 36. The valve 42 has a handle 46 which can be operated manually or automatically to open and close the valve. The gas supply which is connected with the supply hose 44 is used to force the chemical solution or gas through the hose 44 and downwardly into the tubing 18 which directs the chemicals or gas downwardly to the area in the well occupied by the screen 14 or open hole rock.

The pump 24 is surrounded by a cylindrical shroud 48 having a flange 50 at the top and a solid cylindrical body 52 extending downwardly from the flange 50. The body has a diameter smaller than that of the well bore 12, and the flange 50 may be connected with the tubing 18 at a location to enclose the pump 24 within the body 52 of the shroud. The bottom end of the body 52 is equipped with a plurality of agitator disks 54 and/or a wire brush (not shown). The disks 54 may have a diameter slightly less than or equal to that of the screen 14. The agitator disks 54 and/or the wire brush rub against the screen or inside the well and are used to assist in dislodging plugging materials from the screen 14 by moving the well cleaning tool up and down such that the disks 54 engage the entire surface area of the screen 14. The bottom end of the shroud 48 is open and is located at a level coincident with the screen 14.

A gas injection line 56 extends downwardly from a location above the level of the ground 13 and into the well through the packer 20. The injection line 56 connects below the packer with a hose 58 which extends downwardly into the shroud 48. Hose 58 connects with a tube 60 which extends out through the open bottom of the shroud body 52. The lower end of the injection tube 60 is located below the bottom end of shroud 48. For example, the tube 60 may have an open bottom end which is located 5–20 feet below the disks 54.

A tee fitting 62 is secured to the top end of the injection line 56 and is provided on its top end with another fitting 64. Fitting 62 has a side inlet that connects through a valve 66 with an injection hose 68. The end of the hose 68 connects with a source of a suitable gas which may be air, nitrogen, carbon dioxide or another suitable gas under pressure. Valve 66 has a handle 70 which may be manually or automatically operated to open and close the valve.

In use, the tool may be employed to clean the screen 14 and gravel pack formation 16, or fractures of consolidated formations, which may be plugged with foreign or natural materials. With the packer 20 in a deflated condition, the tool is lowered into the well until the packer reaches the desired location, either above the top of the screen 14 or in the screen or open hole producing zone. The packer 20 can then be inflated through the air line 22. When the packer is fully inflated, it acts against the wall of the well bore 12 to secure the tool in place.

The valve handle 34 is moved to the closed position to close valve 30. Handles 46 and 70 are both moved to their open positions to open valves 42 and 66. The chemical solution and/or gas is then applied through the hose 44 and downwardly through the surge line 36 and the tubing 18 into the interior of the shroud 48. The pressurized gas which is applied to the hose 44 forces the chemical solution (or gas) through the tubing 18 and out into the interior of the shroud 48. The applied chemicals and/or gas are forced out through the bottom end of the shroud 48, as indicated by the arrows 72.

At the same time as the chemicals and/or gas are applied, gas is injected into hose 68 and flows downwardly through the injection line and into tube 60, from which the injected gas discharges into the well at a location below the location at which the chemicals are injected. The injected gas rises within the well and provides a force opposing the force of the chemicals or gas applied at location 72. These opposing forces create a surging effect which drives the chemicals and/or gas out through the screen 14 and into the formation 16 to dislodge and/or chemically dissolve materials that plug the screen 14 and formation 16.

The chemical application and gas injection are simultaneously terminated at a selected time after they are initiated. The pressure in the well bore 12 is reduced when the chemical application and gas injection are stopped, and this reduction in pressure draws the dislodged material back through the screen into the well bore 12. The dislodged waste material can be removed from the well by opening the valve 30 and energizing pump 24 to pump the dislodged material from the well bore into the line 32 for proper disposal.

The process of applying chemicals and injecting gas can be repeated for as many cycles as is deemed necessary to effectively clean the screen 14 and formation 16. After each cycle, the material which is pumped through the line 32 can be visually inspected. Normally, when it is determined that there is little dislodged material during a pumping cycle, completion of the well cleaning process for the section of the well can be considered to be completed.

After the screen 14 and/or section of the well has been cleaned, the packer 20 can be deflated through the line 22, and the tool can then be lowered (or raised) until the packer is immediately above the next section in the well. The packer is inflated again, and the process is repeated to clean the next section of the well and the surrounding formation. Each well zone is cleaned in succession in this fashion.

Rather than pumping the material that is dislodged at each well zone, the entire well can be cleaned, and all of the dislodged material can then be pumped at one time to the surface by activating the pump.

Figure 2:
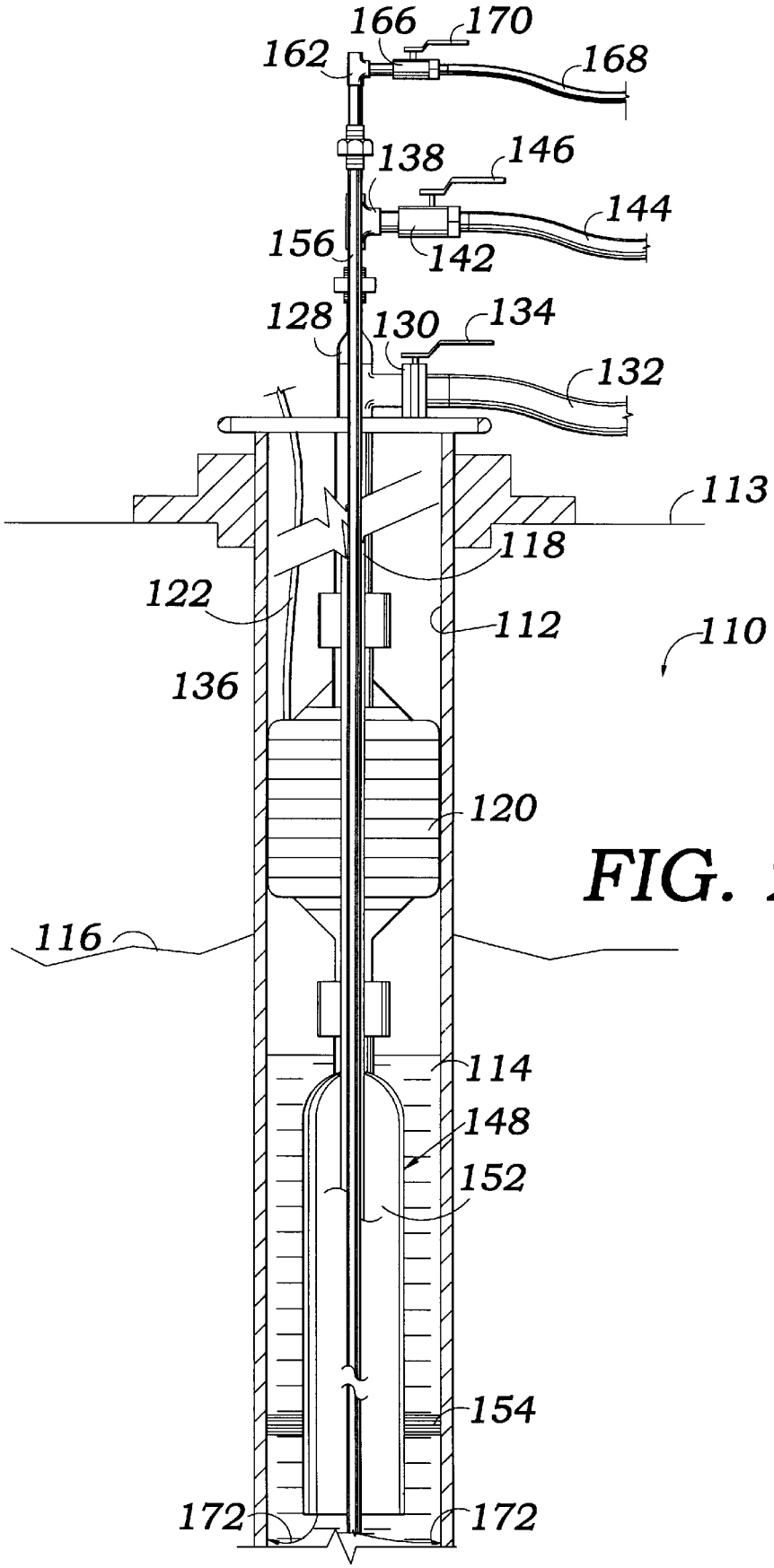

FIG. 2 depicts a somewhat modified form of the tool that is used to effect cleaning of wells in accordance with the present invention. A well 110 has a bore 112 which extends downwardly from the surface 113. A screen 114 lines the well bore and is surrounded by a gravel pack 116 or other formation. A tubing string 118 extends downwardly into the well from the surface and connects with an inflatable packer 120 which can be inflated and deflated through an air line 122. A fitting 128 is connected with the upper end of the tubing string 118 above the ground surface and connects through a valve 130 with a delivery hose 132. The valve 130 is equipped with a handle 134 which can be operated to open and close the valve 130.

A surge tube 136 extends downwardly concentrically through the tubing string 118.

The tube 136 has a smaller diameter than the tubing string 118. By way of example, tubing 118 may be 4 or 6 inches in diameter and tube 136 may be 2 inches in diameter. A fitting 138 connects with the top end of the surge tube 136. Fitting 138 has a side which connects through a valve 142 with a hose 144. Valve 142 is equipped with a handle 146 which can be manually or automatically operated to open and close valve 142.

The lower end of the tubing string 136 connects with a shroud 148 having a cylindrical body 152 and a plurality of agitating disks 154 and/or a wire brush on its lower end portion. The lower end of the surge tube 136 is open and opens within the interior of the shroud 148.

An injection tube 156 extends downwardly concentrically within the surge tube 136 and the tubing string 118. If surge tube 136 is a 2 inch diameter tube, the injection tube 156 may be one inch in diameter. The injection tube 156 extends below the open lower end of the shroud 148. By way of example, the lower end of tube 156 may be open and may be located between five and twenty feet below the open lower end of the shroud 148. A fitting 162 connects with the top end of the injection line 156. Fitting 162 may be plugged at the top, the side of the fitting 162 connects through a valve 166 with an injection hose 168. Valve 166 has a handle 170 which can be manually operated to open and close valve 166.

The embodiment of the invention shown in FIG. 2 is used in a manner similar to the embodiment of FIG. 1. With the packer 120 in a deflated condition, the tool is lowered until the packer is located slightly above the screen 114 or in a screened or open hole zone of the well. The packer 120 is then inflated through the air line 122 to expand against the walls of the well bore 112 and thus secure the tool in place. Valve handle 134 is closed and valve handles 146 and 170 are opened. A chemical solution may then be forced under gas pressure through hose 144 and downwardly through the surge tube 136 into the shroud 148. The chemicals are forced out through the open bottom of the shroud, as indicated by the directional arrows 172.

At the same time, gas is injected through hose 168 and flows downwardly through tube 156. The gas that is injected enters the well through the open lower end of tube 156 which is well below the location at which the chemicals discharge from the bottom end of the shroud 148. The opposing forces created by the applied chemicals and the injected gas cause a surging effect which forces the chemicals or gas and water out through screen 114 and the formation 116. Again, the application of the chemicals and the injection of gas are terminated, thus reducing the pressure within the well and drawing the dislodged materials into the well bore. The dislodged materials can be removed from the well using conventional gas lifting techniques that involve applying air or another gas through the surge tube 136 in order to lift the water to the surface through the tubing 118. The dislodged materials can then be dealt with in an appropriate manner through tube 132.

Again, if there are multiple screens in the well or a long screened or open hole length, the producing zone at each screen or open hole can be cleaned in a separate operation that may involve several cycles of surging followed by air lifting of the dislodged materials to the surface. Alternatively, the dislodged materials can be air lifted or gas lifted to the surface at one time at the end of the cleaning operation.

The embodiments shown in FIGS. 1 and 2 thus operate in substantially the same manner and use substantially the same methodology to clean the well screen and surrounding formation and to remove and dispose of the dislodged materials. The principal difference is that gas lifting techniques are used for removal in the embodiment of FIG. 2, whereas the submersible pump 24 is used to remove the dislodged materials in the embodiment of FIG. 1. Additionally, the pipes 118, 136 and 156 are telescoped one within the other for a compact arrangement that is advantageous in many applications.

It is contemplated that the surge tool can be carried on coiled tubing and placed into a well using the coiled tubing such as high density polyethylene (HDPE). In many cases, this would allow the cleaning process to be completed more quickly. It is within the scope of this invention to use surging techniques that involve surging of the well by means of a pump. This can include supplying carbon dioxide or another gas into the well through a pump. It is also to be noted that the method and apparatus of this invention is used with horizontal wells in addition to vertical wells, including horizontal water supply wells and extraction or recovery wells of the type used in environmental applications.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A method of cleaning a water well in which a pump is installed on a tubing string through which water is pumped from the well by the pump, comprising the steps of:

shrouding the pump in a shroud having an open bottom;

applying fluid to the well at a selected level within the shroud so that the fluid enters the well through the open bottom of the shroud;

injecting gas into the well at a location below the open bottom of the shroud to drive the fluid and/or gas outwardly to dislodge materials from the well perimeter;

terminating the application of fluid and the injection of gas to effect a pressure reduction in the well drawing dislodged material into the well; and removing the dislodged material from the well.

2. A method as set forth in claim 1, wherein said step of applying fluid comprises using gas to force chemicals into the well.

3. A method as set forth in claim 1, wherein said removing step comprises pumping the dislodged material upwardly in the well to the surface.

4. A method as set forth in claim 1, wherein said removing step comprises effecting gas lifting of the dislodged materials upwardly in the well to the surface.

5. A method of cleaning a water well in which a pump is installed on a tubing string through which water is pumped from the well by the pump, said method comprising the steps of:

applying fluid for cleaning of the well through a surge line which is separate from the tubing string;

injecting gas into the well through an injection line which is separate from the tubing string and the surge line and which discharges the gas into the well at a location below the location at which the fluid is applied to the well to thereby drive the fluid and/or gas outwardly to dislodge materials from the well perimeter;

terminating the application of fluid and the injection of gas to effect a pressure reduction in the well drawing dislodged material into the well; and removing the dislodged material from the well.

6. A method as set forth in claim 5, wherein said step of removing the dislodged material from the well is effected immediately following said terminating step.

7. A method as set forth in claim 5, including the steps of de-energizing the pump and closing the tubing string during said applying and injecting steps.

8. A method as set forth in claim 7, wherein said removing step comprises:

opening the tubing string; and energizing the pump to pump the dislodged material out of the well through the tubing string.

9. A method as set forth in claim 8, wherein said opening and energizing steps are effected immediately following said terminating step.

10. A method as set forth in claim 5, including the step of shrouding the pump in a shroud having an open bottom, said surge line applying the liquid at a location within the shroud and said injection line discharging the gas into the well at a location below the bottom of the shroud.

* * * * *